US009010444B2

(12) United States Patent
Quitberg

(10) Patent No.: US 9,010,444 B2
(45) Date of Patent: Apr. 21, 2015

(54) MAGNETIC RETRIEVER FOR WELL PLUNGER

(76) Inventor: Kevin B. Quitberg, Green River, WY (US)

( * ) Notice: Subject to any disclaimer, the term of this patent is extended or adjusted under 35 U.S.C. 154(b) by 825 days.

(21) Appl. No.: 13/373,569

(22) Filed: Nov. 17, 2011

(65) Prior Publication Data

US 2013/0126188 A1 May 23, 2013

(51) Int. Cl.
*E21B 23/00* (2006.01)

(52) U.S. Cl.
CPC ..... *E21B 23/00* (2013.01)

(58) Field of Classification Search
None
See application file for complete search history.

(56) References Cited

U.S. PATENT DOCUMENTS 2,976,075 A * 3/1961 Budreck ..... 294/65.5

* cited by examiner

*Primary Examiner* — Jennifer H Gay
*Assistant Examiner* — Caroline Butcher
(74) *Attorney, Agent, or Firm* — Terry M. Crellin

(57) ABSTRACT

A device for removing and installing a plunger in a well head has a elongate rigid tube with a magnetic connector mechanism at it distal end for engaging the plunger during removal and installation of the plunger. A longitudinal opening or passage can be provided extending the entire longitudinal length of the rigid tube and magnetic connector mechanism. An elongate rod is positioned in the opening or passage so that the upper end of the rod can be moved downwardly to eject the lower end of the rod from the magnetic connector mechanism to thereby disconnect an attached plunger from the magnetic connector mechanism.

17 Claims, 4 Drawing Sheets

MAGNETIC RETRIEVER FOR WELL PLUNGER

BACKGROUND OF THE INVENTION

1. Field of the Invention

This invention relates to apparatus, commonly referred to as retrievers, used in removing and installing plungers in the well head of a hydrocarbon producing well. More specifically the invention relates to such apparatus that employ a magnetic latching mechanism for engaging the plunger in both removing the plunger from a well and replacing a plunger in a well.

2. State of the Art

A plunger lift is an apparatus that is used commonly in the oil and gas industry to increase the productivity of oil and gas wells. Descriptions of the use of such plunger lifts are well described in the following U.S. Pat. Nos. 2,661,024; 6,719,060; 6,935,427; and 7,383,878. As explained in these patents, a plunger is designed to intermittently drop to the bottom of a well and then rise to the top carrying well liquids out of the well that would otherwise collect at the bottom of the well and thus decrease the efficiency of the operation of the well.

When the plunger rises to the top of the well it is retained in a receiver near the well head until it is to be dropped back down the well. The receiver is also commonly called a lubricator. The plunger requires recurrent maintenance and periodic replacement which requires that the plunger be repeatedly removed from the receiver or lubricator. This is done by taking a cap off the well head and using a retriever apparatus to reach down into the receiver or lubricator and retrieve the plunger through the open end of the well head.

Retrievers have been used that employ different mechanical means to attach to the upper end of the plunger in able to pull the plunger up and out of the well head. These mechanical connectors often employ collets, fingers or other projections that catch an engagement means on the upper end of the plunger. The retrievers are carried from well to well in the back of a truck of the person servicing the well, and the collets, fingers or other projections are subject to being broken and bent to where they are unusable. Further dirt and grime can accumulate in the fingers and projections again rendering them inoperable at least until they are thoroughly cleaned.

A retriever has been used that employs a magnetic connection between the distal end of the retriever and the plunger. In FIG. 1 there is shown a longitudinal cross-sectional view through such a retriever that is currently being used and which uses a magnetic connection with the plunger. As shown in FIG. 1, the prior art retriever comprises an elongate, solid handle 10 that is cylindrical in shape, i.e., has a round transverse cross-section. The handle 10 is made of aluminum. A block 11 of polymeric material such as polyethylene is press fit onto the distal end of the handle 10. A bore 12 is formed inwardly from the distal end of the block 11, and a magnet 13 is received in that bore 12. The magnet 13 is itself press fit into a brass ring 14, which in turn is press fit into a steel ring 15, with the assembled magnet 13, and rings 14 and 15 being press fit as a unit into the bore 12 of the block 11 at the distal end of the handle 10. A series of grooves 16 are formed near the proximal end of the handle 10 as means for firmly grasping the handle 10.

In the device of the prior art as shown in FIG. 1, the face 18 of the magnet 13 is exposed and subject to being impacted at its exposed face by other tools and so forth as it is being transported in the bed of a truck from one well to another. The magnet 13 is very brittle and subject to being broken by such impacts on the exposed face 18 of the magnet 13. To minimize impact of the magnet 13 with the plunger when the retriever is being used, the block 11 is provided with a circular, projecting lip 17 from the face 18 of the magnet 13 at the perimeter of the block 11.

In use, that lip 17 can be worn away or broken away which can result in the plunger impacting the magnet 13 when the retriever is lowered into the well head to retrieve the plunger. Again, the magnet 13 is very brittle and it is imperative that the magnet 13 is not chipped or broken such that pieces of the magnet 13 get dropped into the well. Thus, care must be exercised to insure that there has been no damage to the lip 17 whenever the retriever is used.

When the lip 17 is in proper, undamaged condition, the stand-off space created between the plunger and the magnet 13 by the lip 17 decreases the lifting power of the retriever. Another problem associated with the existing magnet retriever is its inability to readily let go of the plunger when inserting the plunger through the well head into the receiver of the well. The magnetic retriever of the prior art as shown in FIG. 1 has to be vigorously shaken to disengage the plunger from the magnetic connection. That risks damaging the plunger and the receiver or lubricator of the well when the plunger drops when it breaks magnetic connection to the retriever.

SUMMARY OF THE INVENTION

In accordance with this invention, an improvement is made in a retriever device using a magnetic connection between the retriever and the plunger. The improved magnetic retriever device is used for alternatively removing and installing a plunger in a receiver located at the well head of a hydrocarbon producing well, and the invention also includes a novel method of using the retriever to install a plunger in the receiver of the well.

The device of the present invention comprises a straight, elongate, rigid member having a metallic mounting block integrally attached to a distal end of the rigid member. The proximal end of the mounting block is attached to the distal end of the rigid member, and the mounting block further has a proximal end, with a side wall connecting the distal and proximal ends thereof. The mounting block has a bore that extends inwardly from its distal end, and a magnet is fit snugly in the bore in the mounting block.

A metallic cup member is provided for securely retaining the magnet within the bore of the mounting block as well as to provide a means of preventing impacts of any object directly against the otherwise open face of the magnet. There is no chance that pieces of the magnet can be chipped off or broken therefrom and fall into the well. The cup has a side wall that extends from the perimeter of an end wall, whereby the side wall forms an otherwise open end of the cup member. The otherwise open end of the cup is press fit over the distal end of the mounting block.

To achieve a secure, tight press fit of the side wall of the cup member with the distal end of the mounting block, the side wall of the cup member has an internal face that has a circumferential shape corresponding to an outer circumferential shape of the side wall of the mounting block. In addition, the internal face of the side wall of the cup member has a circumferential dimension that is slightly less than corresponding circumferential dimension of the side wall of the mounting block, so that the side wall of the cup member makes a tight, secure, press fit around the side wall of the mounting block. The magnet is thus permanently retained tightly in the bore of the mounting block.

The rigid member, the mounting block and the cup member, of course, have circumferential dimensions that will allow the retriever device to be inserted longitudinally into the well head and receiver of the well.

In preferred embodiments of the invention novel means are provided for easy, reliable disengagement of the plunger from the magnet when the plunger is being installed in the receiver of the well head. In those embodiments, a mechanical disengagement of the plunger is achieved that does not involve shaking or other sudden movement of the retriever to disengage the plunger from the magnetic connection at the end of the retriever. In the preferred embodiments, a longitudinal, central bore is provided from the proximal end of the rigid member to the distal end thereof.

A push rod is positioned in the continuous bore of the retriever device for longitudinal movement back and forth in that continuous bore. The push rod has its proximal end extending from the proximal end of the rigid member of the retriever device. Means are provided for restricting the longitudinal movement of the push rod back and forth inside the rigid member, and the lower end portion of the push rod is further mechanically linked to appropriate mechanical means for disengaging the plunger from the magnet and thereby readily and safely releasing the plunger from the magnet on the retriever device when the plunger is being installed in its proper place in the receiver or lubricator of the well.

In installing a plunger into the well, the distal end of the push rod is contained within the bore of the retriever, and the plunger is attached at its upper end to the magnet on the distal end of the retriever device. The plunger and retriever are introduced longitudinally into the well through the well head until the plunger is in its desired position in the receiver or lubricator. At that point, the push rod and rigid member are moved relative to each other so as to activate the means for disengaging the plunger from the magnet at the end of the retriever device. The plunger is thus gently but firmly released from its magnetic connection to the retriever device, and there is no chance of the plunger being dropped into the receiver or lubricator.

BRIEF DESCRIPTION OF THE DRAWINGS

FIGS. 7 and 8 are a cross-sectional views taken along line 7-7 of FIG. 2, line 8-8 of FIG. 5, respectively.

DESCRIPTION OF THE PREFERRED EMBODIMENTS

Figure 1:
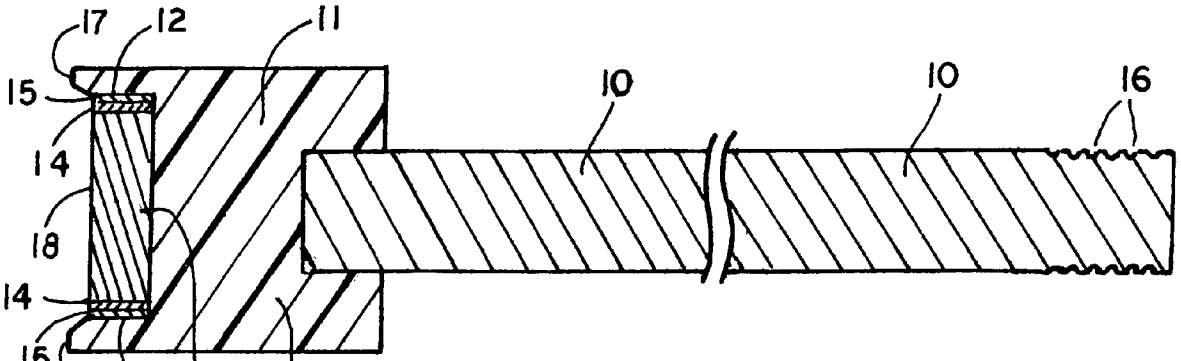
FIG. 1 (PRIOR ART)
FIG. 1 (prior art) is a longitudinal cross-sectional view of a prior art retriever device that utilizes a magnet to attach the plunger to the distal end of the retriever.

Various preferred embodiments of the retriever device of the present invention for alternatively removing and installing a plunger in a receiver located at the well head of a hydrocarbon producing well in accordance with the present invention are shown in FIGS. 2 through 8 of the drawings. In the drawings, the same reference numbers designate the same elements having the same basic functions in each of the various embodiments.

As illustrated, the device comprises a straight, elongate, rigid, cylindrical tube 20 having a round exterior periphery, and a longitudinal opening 21 extends from a proximal end 23 of the rigid tube 20 to a distal end 22 of that tube 20. A metallic mounting block 24, having a distal end 25 and a proximal end 26, is securely attached at its proximal end 26 to the distal end 22 of the rigid tube 20 by appropriate means that will be described in more detail hereinafter. A cylindrical side wall 27 forms the outer periphery of the mounting block 24, with the side wall 27 extending between the distal end 25 and proximal end 26 of the mounting block 24.

A first bore 29 extends inwardly from a distal end 25 of the mounting block 24. The bore 29 is, of course, circular in shape, and any reference to a bore in this specification will also be one having a circular shape. The center axis of the first bore 29 is in substantially longitudinal alignment with a center axis of the longitudinal opening 21 in the rigid tube 20.

The circular-shaped first bore 29 forms a cavity which receives a circular-shaped magnet 30 therein. The magnet 30 has a substantially circular perimeter that is received snugly in the first bore 29, with the inner face of the magnet 30 abutting the inner end of the first bore 29. The magnet 30 is sized such that it is received in its entirety within the first bore 29.

A second bore 31 extends inwardly from a proximal end 26 of the mounting block 24. The second bore 31 is in substantially longitudinal alignment with the center axis of the longitudinal opening 21 in the rigid tube 20. The second bore 31 extends inwardly to meet with and join the first bore 29, so that an inner end of the second bore 31 opens into the inner end of the first bore 29. The magnet 30 retained in the first bore 29 abuts the inner end of the second bore 31. A third bore 32 extends through magnet 30, with the third bore 32 being in substantially longitudinal alignment with the longitudinal opening 21 in the rigid tube 20. The third bore 32 is also in substantially longitudinal alignment with the first and second bores 29 and 31 of the mounting block 24.

A metallic cup member 33 is provided to encapsulate the perimeter sides and distal end of the mounting block 24. The metallic cup member 33 has a substantially planar end wall 34, with a peripheral side wall 35 extending from the perimeter of the end wall 34 in a direction substantially perpendicular to the end wall 34. The free, distal end of the side wall 35 terminates in an otherwise open end of the cup member 33 facing away from the substantially planar end wall 34 of the cup member 33. A central opening 38 having a substantially circular shape is provided in the planar end wall 34 of the cup member 33. The central opening 38 has a diameter that is at least the same as the diameter of the third bore 32 in the magnet 30. Preferably, the diameters of the central opening 38 and the third bore 32 are substantially identical, with the central opening 38 and the third bore 32 being in substantially coaxial alignment so that adjacent peripheral edges of the third bore 32 and the central opening 38 lie in abutting, side-by-side relationship with each other. Accordingly, the central opening 38 opens directly into the third bore 32.

The peripheral side wall 35 of the cup member 33 has an internal face that has a circumferential shape corresponding to an outer circumferential shape of the outer side wall 27 of the mounting block 24. The internal surface of the peripheral side wall 35 of the cup member 33 has a circumferential dimension that is slightly less than the corresponding circumferential dimension of the outer side wall 27 of the mounting block 24. Preferably, the circumferential dimension of the internal surface of the side wall 35 of the cup member 33 is between about 0.004% and 0.0045% less than the corresponding circumferential dimension of the side wall 27 of said mounting block 24. The side wall of the cup member 33 is press fit around the outer side wall 27 of the mounting block 24 thereby permanently retaining the magnet tightly in the first bore 29 of the mounting block 24.

A straight, elongate rod 36 is positioned for longitudinal movement in the rigid tube 20. The rod 36 has a proximal end 37 that projects outwardly from the proximal end 23 of the rigid tube 20. Means are provided for restraining the longitudinal movement of the rod 36 in the rigid tube 20 so that when the proximal end 37 of the rod 36 moves toward the proximal end 23 of the rigid tube 20, the distal end 39 of the rod 36 moves from a first position in which it is located at least inwardly of an outer face of the planar end wall 34 of the cup member 33 to a second position extending outwardly by at least about 1 cm from said outer face of the planar end wall 34 of the cup member 33.

Figure 2:
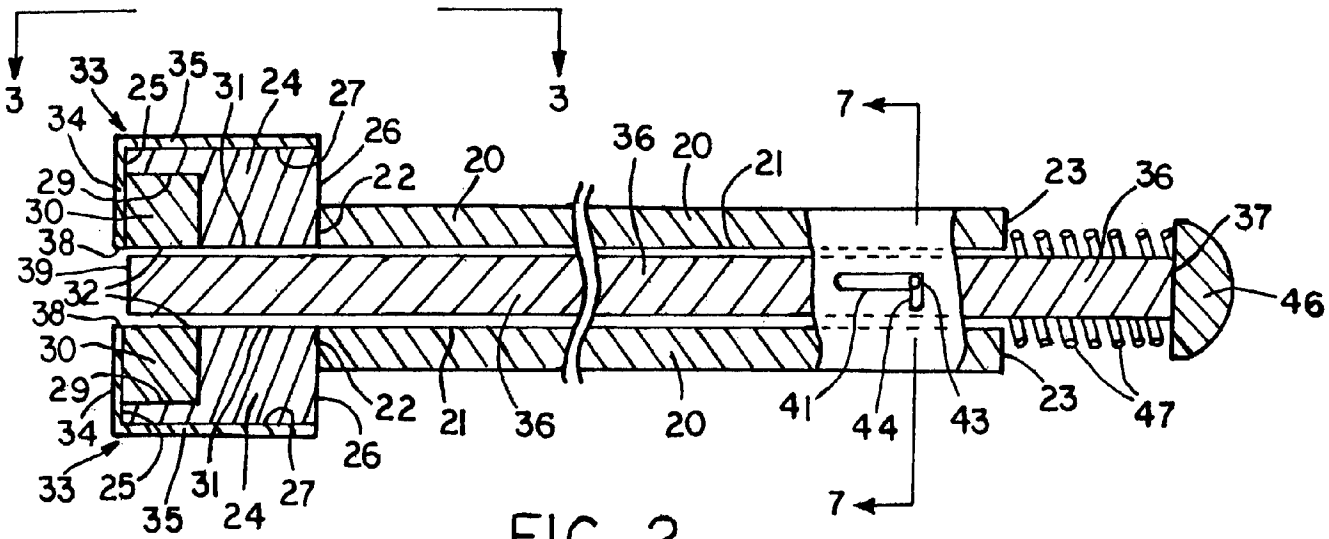
FIG. 2 is a longitudinal cross-sectional view of an improved magnetic retriever in accordance with the present invention.
Figure 7:
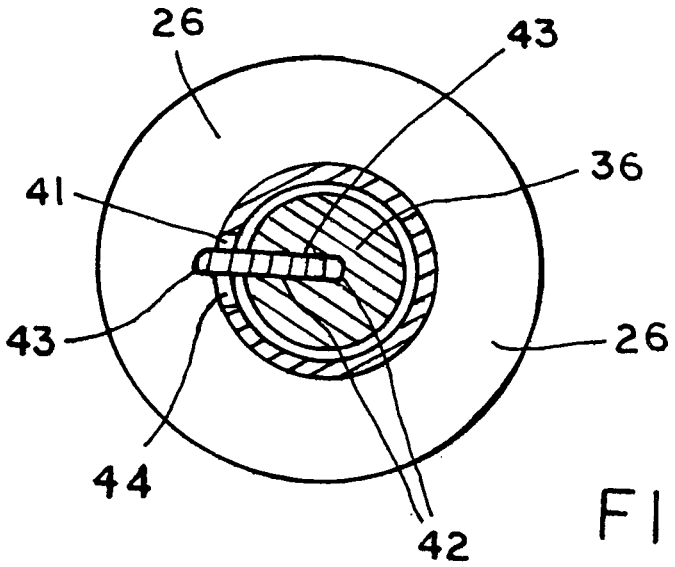
Figure 8:
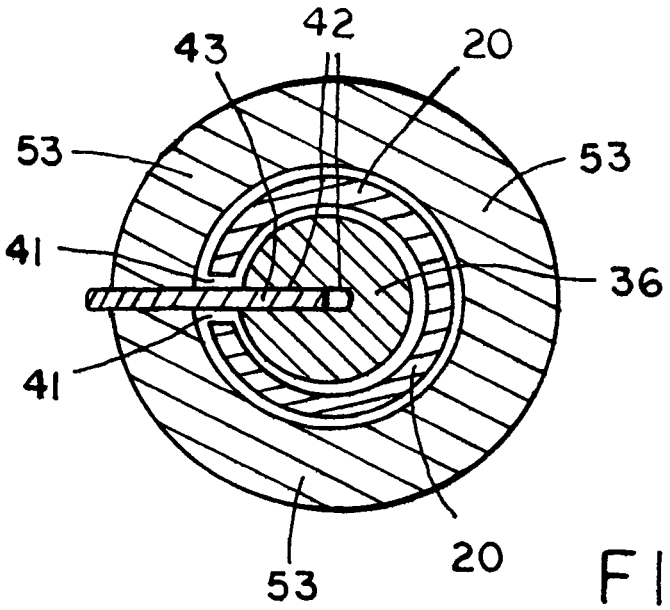

The means for restraining the longitudinal movement of the rod 36 advantageously comprises a relatively short slot 41 that is formed in the side wall of the rigid tube 20 as shown in FIGS. 2 and 7. The center axis of slot 41 is substantially parallel with a center axis of the longitudinal opening 21 in the rigid tube 20. A transverse opening 42 (see FIG. 7) extends substantially diametrically into the rod 36. A pin 43 is received in the transverse opening 42, with an outer end of the pin 43 projecting outwardly from the transverse opening 42 into the slot 41 in the rigid tube 20. The longitudinal movement of the rod 36 is thus restrained to the movement of the pin 43 back and forth in the slot 41.

Means are also provided for returning the rod 36 from its second position back to its first position. In one embodiment, a knob 46 is attached at the proximal end of the rod 36, with the knob 46 having a peripheral dimension that is greater than a corresponding peripheral dimension of the rod 36. A coil spring 47 is positioned around the distal end of the rod 36, with the spring 47 being located between the proximal end 23 of the rigid tube 20 and the knob 46. Coil spring 47 biases the rod 36 to automatically return it to its first position when there is no downward force applied to the rod 36.

In a second embodiment of means for returning the rod 36 from its second position to its first position, the actual movement of the rod 36 is done manually rather than being biased by a spring, and means are provided for selectively holding the rod 36 in its second position. In the second embodiment, a side notch 44 can be formed to extend from an end of the slot 41 as shown in FIGS. 2 and 7. The side notch 44 projects substantially transverse of the slot 41 at the end of the slot 41 that is closest to the distal end 22 of rigid tube 20. The side notch 44 forms a detente into which the pin 43 can be positioned to retain the rod 36 in its first position. The rod 36 is moved so that the pin 43 is positioned adjacent to the side notch 44, and then the rod 36 is rotated so that the pin 43 moves into the side notch 44.

It should be recognized that the notch 44 would be superfluous and not necessary when a coil spring 47 is employed as described above. Vice versa, the coil spring 47 would not be necessary when the notch 44 is used.

The rigid tube 20, the mounting block 24 and the cup member 33 all have circumferential dimensions that will allow the mounting block 24, the cup member 33 and the rigid tube 20 to be inserted longitudinally into the receiver of a well head of a hydrocarbon producing well.

Figure 3:
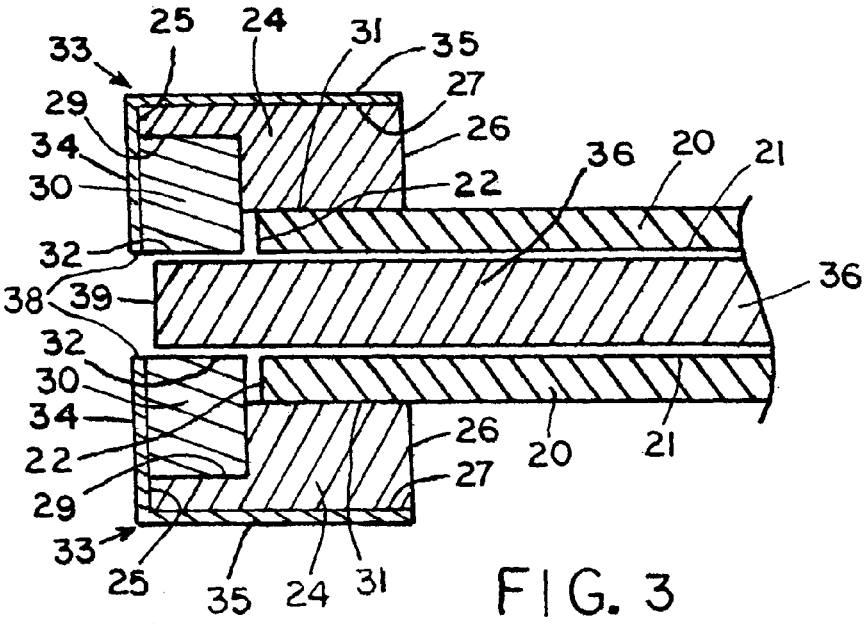
FIGS. 3 through 7 are partial longitudinal cross-sectional views of five similar but slightly different embodiments of the retriever in accordance with the present invention, with the cross-sectional views being taken along line 3-3 of FIG. 2.

As mentioned previously, means are provided for attaching the proximal end 26 of the mounting block 24 to the distal end 22 of the rigid tube 20. Two preferred embodiments of such means are disclosed. In the first embodiment as illustrated in FIG. 3, the second bore 31 in the mounting block 24 is, of course, cylindrical in shape, and it is provided with internal threads. The distal end 22 of the rigid tube 20 has a cylindrical peripheral shape, and the distal end 22 is provided with external threads that engage the internal threads in the second bore 31 of the mounting block 24. In this embodiment, the distal end 22 of the rigid tube 20 is threaded completely through the second bore 31 such that the distal end 22 extends to approach but not contact an inner face of the magnet 30.

Figure 4:
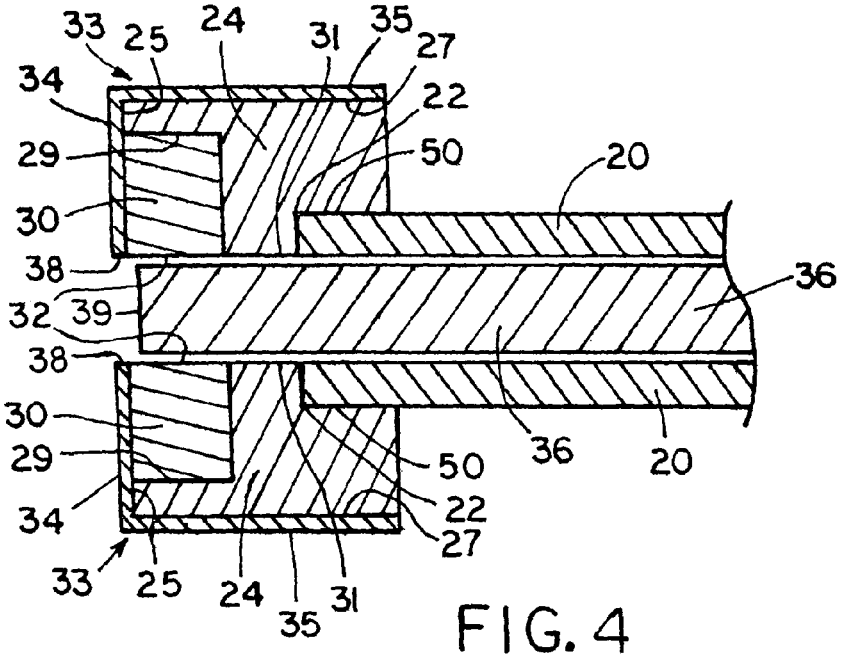

In the second embodiment as illustrated in FIG. 4 a counter bore 50 extends inwardly around and along the second bore 31 in the mounting block 24 from the proximal end 26 of the mounting block 24. The counter bore 50 is, of course, cylindrical in shape, and it is provided with internal threads. The distal end 22 of the rigid tube 20 has a cylindrical peripheral shape, and the distal end 22 is provided with external threads that engage the internal threads in the counter bore 50 of the mounting block 24. In this embodiment, the counter bore 50 does not extend along the entire length of the second bore 31, and the distal end 22 of the rigid tube 20 is threaded into the counter bore 50 so that it is firmly and securely held in the counter bore 50.

In all embodiments of the invention, the rigid tube 20 is preferably made of aluminum, the mounting block 24 is preferably made of carbon steel, and the cup member 33 and the rod 36 are both preferably made of stainless steel. Further, means can be provided for firmly grasping the proximal end 23 of the rigid tube 20. Although not shown in the drawings, the means for grasping the rigid tube 20 can be a series of spaced apart, peripheral indentations formed at the proximal end 23 of the rigid tube 20 in a very similar manner to the series of grooves 16 of the prior art retriever shown in FIG. 1.

The embodiments of the invention as described heretofore are advantageously used when removing and installing plungers that have a relatively solid upper surface. In using the retriever of such embodiments to remove a plunger from a well head, the distal end 22 of the tube 20 and its associated mounting block 24 and magnet 30 is inserted longitudinally into the well head until the cup member 33 and magnet 30 contact the upper end of the plunger. The tube 20 is then pulled from the well head, and the plunger is readily detached from its magnetic attachment to the magnet 30.

When using the retriever as described heretofore to install a plunger in a receiver located at the well head of a hydrocarbon producing well, the upper end of a plunger is magnetically attached to the cup member 33 and magnet 30, and the plunger and tube 20 are inserted longitudinally into the well head to position the plunger at a desired position in the receiver at the well head. Then, the proximal end 23 of the rod 20 is pushed downwardly while simultaneously pulling upward on an proximal end 23 of the rigid tube 20 to gently release the plunger from magnetic attachment with the magnet 30. The tube 20, with the magnet 30 and the rod 36 are then withdrawn from the well head.

Alternative, preferred embodiments of the invention are used when the plunger is of a construction that has an opening located in the center of the plunger. In that situation, the distal end 37 of the rod 36 as shown in the embodiments of FIGS. 2-4 would not contact the plunger as the rod 36 is moved to its second position extending from the exposed face of the planar end wall 34 of the cup member 33. One of the alternative embodiments is shown in FIG. 5.

Figure 5:
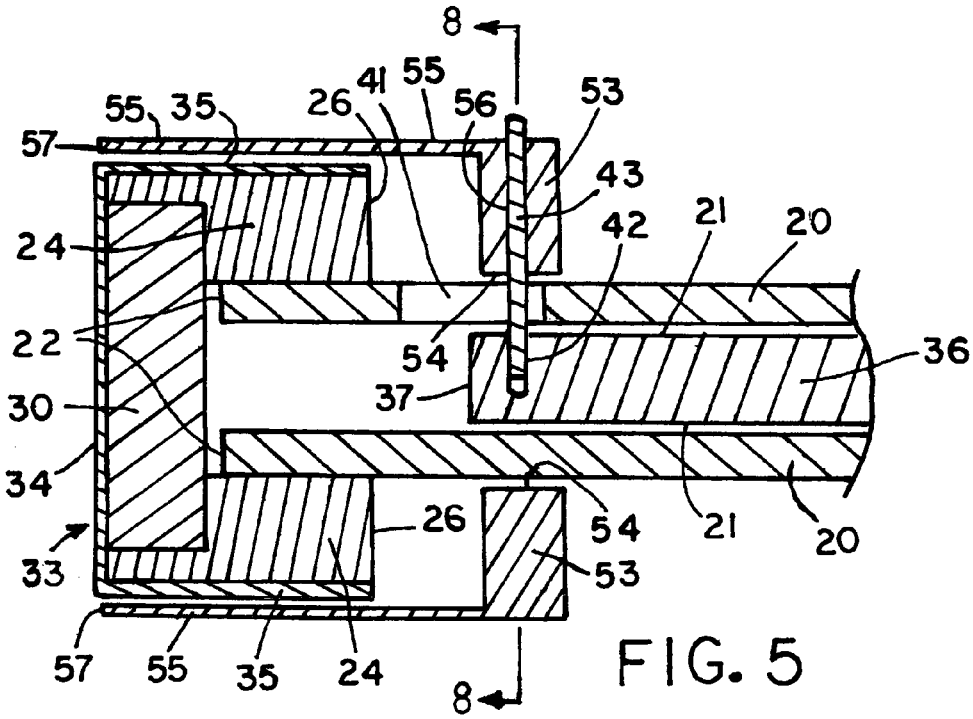

In the embodiment illustrated in FIG. 5, the rigid tube 20, longitudinal opening 21, the elongate rod 36, the mounting block 24, the magnet 30 and the cup member 33 are all basically the same, with substantially the same functions, as the like numbered elements of the embodiments of FIGS. 2-4. The means for restraining the longitudinal movement of the rod 36, i.e., the slot 41, the pin 43 and the opening 42 in the rod 36 have the same functions as the same numbered elements of the embodiments as shown in FIGS. 2-4, but have been relocated to a position near the distal end 22 of rigid tube 20 and the distal end 39 of the rod 36.

When the rod 36 moves downwardly, a distal end 39 of the rod 36 moves from a first position in which it is spaced inwardly by at least about 1 cm from the proximal end 26 of the mounting block 24 to a second position in which the distal end 39 of the rod 36 at least approaches the proximal end 26 of the mounting block 24.

A disengagement member is provided that comprises a base member 53 that has a central orifice 54 extending there through so that the orifice 54 encircles the rigid tube 20 whereby the base member 53 can move back and forth longitudinally along the rigid tube 20. A skirt 55 extends from a periphery of the base member 53 so that the skirt 55 surrounds the cup member 33 and can move smoothly back and forth over the surface of the cup member 33 as the base member 53 moves longitudinally back and forth along the rigid tube 20.

Means are associated with the distal end 39 of the rod 36 for moving the disengagement member. Such means comprises positioning the slot 41 near the distal end 22 of the rigid tube 20, with the pin 43 extending through the slot 41 in the rigid tube 20 so that the pin 43 projects outwardly from an outer surface of the rigid tube 20 and engages a substantially round receiver opening 56 that is provided extending substantially axially into the base member 53 from the orifice 54 in the base member 53. The pin 43 is received securely in the receiver opening 56 in the base member 53 so that the base member 53 moves back and forth as the pin 43 moves back and forth in the slot 41.

When the distal end 39 of the rod 36 moves toward the distal end 22 of the rigid tube 20, a distal, exposed end 57 of the skirt 55 projects outwardly away from the outer face of the planar end wall 34 of the cup member 33. Thereafter, when the distal end 39 of the rod 36 moves back away from the distal end 22 of the rigid tube 20, the skirt 55 retracts back over the sidewall 35 of cup member 33 so that the exposed end 57 of the skirt 55 does not project from the outer face of the planar end wall 34 of cup member 33.

Although not shown explicitly in FIG. 5, it is to be recognized that the magnet 30 of FIG. 5 could be provided with a bore 32 as shown in the embodiments of FIGS. 2-4, and the planar end wall 35 of FIG. 5 could be provided with a central opening 38 as shown in FIGS. 2-4. The distal end 39 of the rod could be extended down into the bore in the magnet so that the distal end 39 projects out through the opening in the cup member 33 when the skirt 55 projects outwardly away from the outer face of the planar end wall 34 of the cup member 33.

Figure 6:
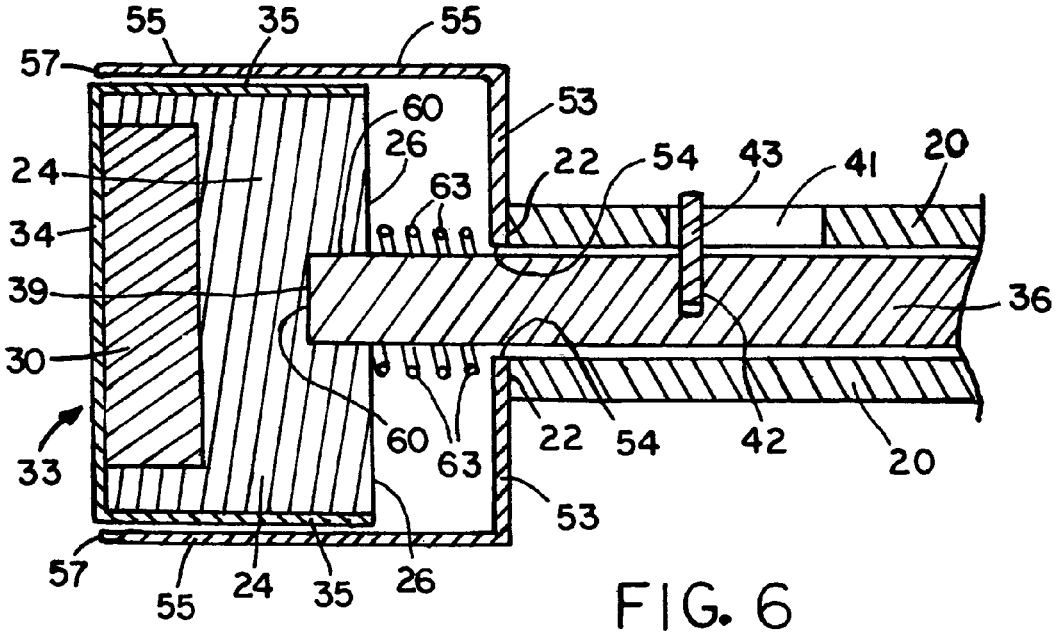

The embodiment of the invention shown in FIG. 5 can be modified slightly as shown in FIG. 6. In the embodiment shown in FIG. 6, the rod 36 extends through the rigid tube 20 as in the other embodiments of the invention that have previously been described. But, in the embodiment shown in FIG. 6, the distal end 39 of the rod 36 is securely attached to the proximal end 26 of the mounting block 24. As shown in FIG. 6, the end 39 is provided with external threads which are received in a threaded bore 60 in the proximal end 26 of the mounting block 24. The magnet 30 is encapsulated in the mounting block 24 by cup member 33 in the same manner as previously described herein.

In the embodiment shown in FIG. 6, the distal end 22 of the rigid tube 20 is securely attached to the base member 53 of the disengagement member. The orifice 54 of the base member 53 encircles the rod 36 as described hereinbefore with respect to the embodiment illustrated in FIG. 5. The skirt 55 of the disengagement member extends from the periphery of the base member 53 as previously described with respect to the embodiment illustrated in FIG. 5. Means for restricting movement of the rod 36 within the rigid tube 20 comprises the short slot 41 in rigid tube 20. A pin receiving opening 42 is provided in rod 36, and a pin 43 is positioned in the pin receiving opening 42, with the pin 43 extending from the rod 36 through the slot 41 in the rigid tube 20. The rod 36 can move so that the distal end 57 of the skirt 55 will project by at least 1 cm from an outer face of the planar end wall 34 of the cup member 30. A coil spring 63 can be provided in the space between the proximal end 26 of the mounting block 24 and the base member 53 to bias the base member 53 to a position in which the exposed end 57 of the skirt 55 is withdrawn back over the sidewall 35 of the cup member 33.

When using the embodiment of the invention shown in FIG. 6, a plunger is magnetically attached to the magnet 30 and planar end wall 34 of the cup member 33. The plunger is then positioned in its desired placement in a receiver of a well head as previously described herein. The plunger is then disengaged from the magnet 30 and planar end wall 34 of the cup member 33 by depressing the rigid tube 20 while simultaneously pulling the rod 36 in an opposite direction. The exposed end 57 of the skirt 55 holds the plunger in place while the movement of the rod 36 pulls the magnet 30 and cup member 33 away from the plunger so that the plunger is disengaged from its former magnetic attachment to the magnet 30 and cup member 33.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

The invention claimed is:

1. A device used in maintenance of a hydrocarbon producing well, said device comprising a substantially straight, elongate, rigid member;

a metallic mounting block;

said mounting block having a distal end, a proximal end and an outer side wall extending between said distal end and said proximal end;

means for attaching said proximal end of said mounting block to a distal end of said rigid member;

a circumferential depression extending inwardly from a distal end of said mounting block;

a magnet having a substantially circular perimeter is received in its entirety in said circumferential depression in said mounting block, with an inner face of said magnet abutting an inner end of said circumferential depression;

a metallic cup member having a substantially planar end wall, with a peripheral wall extending from a perimeter of said planar end wall, so that a free distal end of said peripheral wall terminates in an otherwise open end facing away from said planar end wall of said cup member;

said peripheral wall of said cup member having an internal surface that has a circumferential shape corresponding to an outer circumferential shape of said outer side wall of said mounting block;

said internal face of said peripheral wall of said cup member having a circumferential dimension that is slightly less than a corresponding circumferential dimension of said outer side wall of said mounting block so that said peripheral wall of said cup member is press fit around said outer side wall of said mounting block thereby permanently retaining said magnet tightly in said circumferential depression in said mounting block; and said rigid member, said mounting block and said cup member having circumferential dimensions that will allow said mounting block, said cup member and said rigid member to be inserted longitudinally into said hydrocarbon producing well.

2. The device of claim 1 wherein said circumferential dimension of said internal surface of said peripheral wall of said cup member is between about 0.004% and 0.0045% less than said corresponding circumferential dimension of said outer side wall of said mounting block.

3. The device of claim 1 wherein said rigid member is made of metal;

said means for attaching said proximal end of said mounting block to a distal end of said rigid member comprises a bore extending inwardly from said proximal end of said mounting block;

said bore being cylindrical in shape, with said bore further being provided with internal threads; and said distal end of said rigid member has a cylindrical peripheral shape, with said distal end of said rigid member being provided with external threads that engage said internal threads in said bore of said mounting block.

4. The device of claim 3 wherein said rigid member is made of aluminum;

said mounting block is made of carbon steel; and said cup member is made of stainless steel.

5. The device of claim 1 wherein said rigid member is a substantially straight, elongate tube;

a longitudinal opening extends from a proximal end of said rigid member to a distal end of said rigid member;

a first bore extends inwardly from a proximal end of said mounting block, with a center axis of said first bore being in substantially longitudinal alignment with said center axis of said longitudinal opening in said rigid member;

said first bore extends inwardly to said circumferential depression in said mounting block so that an inner end of said first bore opens into an inner end of said circumferential depression in said mounting block;

a second bore extends through said magnet, with a center axis of said second bore being in substantially longitudinal alignment with said center axis of said longitudinal opening in said rigid member, and further with said second bore opening into said first bore in said mounting block;

a central opening having a substantially circular shape is provided in said planar end wall of said cup member, said central opening having a diameter that is at least the same as a diameter of said second bore in said magnet, with said central opening and said second bore being in substantially coaxial alignment;

a substantially straight, elongate rod positioned for longitudinal movement in said rigid member;

said rod having a proximal end that projects outwardly from said proximal end of said rigid member; and means for restraining said longitudinal movement of said rod in said rigid member, so that when said proximal end of said rod moves toward said proximal end of said rigid member, a distal end of said rod moves from a first position in which it is located inwardly of an outer face of said planar end wall of said cup member to a second position extending outwardly by at least about 1 cm from said outer face of said planar end wall of said cup member.

6. The device of claim 5 wherein said means for restraining said longitudinal movement of said rod in said rigid member comprises a short slot formed in said rigid member, with said slot being substantially parallel to said central axis of said longitudinal opening in said rigid member;

a transverse opening extending substantially diametrically into said rod; and a pin extending from said transverse opening into said slot in said rigid member, wherein longitudinal movement of said rod is restrained to the movement of said pin back and forth in said slot.

7. The device of claim 6 further comprising a side notch extending from an end of said short slot that is closest to said distal end of said rigid member, with said side notch forming a detente into which said pin can be positioned by moving said rod so that said pin moves to said side notch at said end of said short slot and then rotating said rod so that said pin moves into said side notch.

8. The device of claim 5 further comprising a knob attached at said proximal end of said rod;

said knob has a peripheral dimension that is greater than a corresponding peripheral dimension of said rod; and a coil spring is positioned around said distal end of said rod, with said coil spring located between said proximal end of said rigid tube and said knob, whereby said coil spring biases said rod to its said first position.

9. The device of claim 5 wherein said circumferential dimension of said internal face of said peripheral wall of said cup member is between about 0.004% and 0.0045% less than said corresponding circumferential dimension of said outer side wall of said mounting block.

10. The device of claim 5 wherein said means for attaching said proximal end of said mounting block to a distal end of said rigid member comprises said first bore of said mounting block is provided with internal threads; and said distal end of said rigid member is provided with external threads that engage said internal threads in said first bore in said mounting block.

11. The device of claim 5 wherein said means for attaching said proximal end of said mounting block to a distal end of said rigid member comprises a counter bore formed at an outer end of said first bore so that said counter bore extends inwardly from said proximal end of said mounting block;

said counter bore is provided with internal threads; and said distal end of said rigid member is provided with external threads that engage said internal threads in said counter bore.

12. The device of claim 5 wherein said rigid member is made of aluminum;

said mounting block is made of carbon steel;

said cup member is made of stainless steel; and said rod is made of stainless steel.

13. The device of claim 1 wherein said rigid member is a substantially straight, elongate tube;

a longitudinal opening extends from a proximal end of said rigid member to said distal end of said rigid member;

a substantially straight, elongate rod is positioned for longitudinal movement in said longitudinal opening of said rigid member;

said rod having a proximal end that projects outwardly from said proximal end of said rigid member;

means for restraining said longitudinal movement of said rod in said rigid member; and means associated with said rod for moving a disengagement member in a direction outwardly from an outer face of said planar end wall of said cup member when said proximal end of said rod moves toward said proximal end of said rigid member.

14. The device of claim 13 wherein said means for restraining said longitudinal movement of said rod in said rigid member comprises a short slot formed in said rigid member, with said slot being substantially parallel to said central axis of said longitudinal opening in said rigid member;

a transverse opening extending substantially diametrically into said rod; and a pin extending from said transverse opening into said slot in said rigid member, wherein longitudinal movement of said rod is restrained to the movement of said pin back and forth in said slot.

15. The device of claim 14 wherein said disengagement member comprises a base member that has a central orifice extending there through so that said orifice encircles said rigid member whereby said base member can move back and forth longitudinally along said rigid member;

a skirt extending from a periphery of said base member so that said skirt surrounds said cup member and can move smoothly back and forth over said metallic cup member as said base member moves longitudinally back and forth along said rigid member; and said means associated with said distal end of said rod for moving said disengagement member comprises positioning said slot near said distal end of said rigid member;

extending said pin through said slot in said rigid member so that said pin projects outwardly from an outer surface of said rigid member; and providing a substantially round receiver opening extending substantially axially into said base member from said orifice in said base member;

said pin is received securely in said receiver opening in said base member so that said base member moves back and forth as said pin moves back and forth in said slot, whereby when said distal end of said rod moves toward said distal end of said rigid member, a distal, exposed end of said skirt projects outwardly away from said outer face of said planar end wall of said cup member, and when said distal end of said rod moves back away from said distal end of said rigid member, said skirt retracts back over said cup member so that said exposed end of said skirt does not project from said outer face of said planar end wall of said cup member.

16. A device used in maintenance of a hydrocarbon producing well, said device comprising a substantially straight, elongate, rigid tube;

a longitudinal opening extends from a proximal end of said rigid tube to said distal end of said rigid tube;

a substantially straight, elongate rod is positioned for longitudinal movement in said longitudinal opening of said rigid tube;

said rod having a proximal end that projects outwardly from said proximal end of said rigid tube;

a metallic mounting block;

said mounting block having a distal end, a proximal end and an outer side wall extending between said distal end and said proximal end;

means for attaching said proximal end of said mounting block to a distal end of said rod;

a circumferential depression extending inwardly from a distal end of said mounting block;

a magnet having a substantially circular perimeter is received in its entirety in said circumferential depression in said mounting block, with an inner face of said magnet abutting an inner end of said circumferential depression;

a metallic cup member having a substantially planar end wall, with a peripheral wall extending from a perimeter of said planar end wall, so that a free distal end of said peripheral wall terminates in an otherwise open end facing away from said planar end wall of said cup member;

said peripheral wall of said cup member having an internal surface that has a circumferential shape corresponding to an outer circumferential shape of said outer side wall of said mounting block;

said internal face of said peripheral wall of said cup member having a circumferential dimension that is slightly less than a corresponding circumferential dimension of said outer side wall of said mounting block so that said peripheral wall of said cup member is press fit around said outer side wall of said mounting block thereby permanently retaining said magnet tightly in said circumferential depression in said mounting block;

a base member having a central orifice extending there through, with a periphery of said orifice being attached concentrically to said distal end of said rigid tube so that said orifice encircles said rod, whereby said base member can move back and forth longitudinally along said rod;

a skirt extending from a periphery of said base member so that said skirt surrounds said cup member and can move smoothly back and forth over said cup member as said base member moves longitudinally back and forth along said rod;

means for restraining said longitudinal movement of said rigid tube along said rod so that an exposed end of said skirt moves back and forth from a first position in which said exposed end of said skirt is retracted back over said cup member to a second position in which said exposed end of said skirt projects outwardly away from an outer face of said planar end wall of said cup member; and said rigid tube, said mounting block, said cup member and said skirt having circumferential dimensions that will allow said mounting block, said cup member, said rigid tube and said skirt to be inserted longitudinally into said hydrocarbon producing well.

17. A method for installing a plunger in a receiver located at a well head of a hydrocarbon producing well, said method comprising attaching an upper end of said plunger to a magnet that is integrally connected to a lower end of a straight, rigid tube having a longitudinal bore extending from an upper end of said tube to said lower end of said tube;

inserting said plunger and said tube longitudinally into said well head to position said plunger at a desired position in said receiver at said well head;

pushing a central rod which is positioned for longitudinal movement in said tube downwardly while simultaneously pulling upward on an upper end of said tube to move a disengagement member at said lower end of said rigid tube to extend downwardly away from said magnet and thereby release said plunger from said magnet; and removing said tube with said magnet, said rod and said disengagement member from said well head.

* * * * *